US005431198A

United States Patent [19]

Turtchan et al.

[11] Patent Number: 5,431,198

[45] Date of Patent: Jul. 11, 1995

[54] APPARATUS AND METHOD OF OPERATION FOR A PRODUCT FILLER MACHINE

[75] Inventors: Alfons Turtchan, Brucknerweg, Germany; Paul DeSocio, Clearwater, Fla.

[73] Assignee: Autoprod, Inc., Clearwater, Fla.

[21] Appl. No.: 246,622

[22] Filed: May 20, 1994

[51] Int. Cl.[6] ..... B65B 1/04; B65B 3/04

[52] U.S. Cl. ..... 141/1; 141/91; 141/258; 222/255; 222/148; 222/135

[58] Field of Search ..... 141/258, 89–92, 141/257–262, 174, 104–106, 1; 222/255, 265, 275, 278, 280, 148, 135, 145

[56] References Cited

U.S. PATENT DOCUMENTS

| | | | |
|---|---|---|---|
| 3,626,997 | 12/1971 | Whitaker et al. | 141/9 |
| 3,850,345 | 11/1974 | Merritt . | |
| 4,373,560 | 2/1983 | Elsworth | 141/129 |
| 4,593,730 | 6/1986 | Reil et al. | 141/258 |
| 4,667,709 | 5/1987 | Fischer et al. | 141/91 |
| 4,676,279 | 6/1987 | von Lersner | 141/1 |
| 4,759,695 | 7/1988 | Bordini | 222/148 X |
| 4,842,026 | 6/1989 | Nordmeyer et al. | 141/1 |
| 4,860,926 | 8/1989 | Juenkersfeld et al. | 222/148 |
| 4,913,202 | 4/1990 | Miller et al. | 141/258 |
| 4,993,598 | 2/1991 | Groninger | 222/148 |
| 5,080,148 | 1/1992 | Florida | 141/266 |
| 5,108,014 | 4/1992 | Nordmeyer et al. | 222/148 X |
| 5,127,449 | 7/1992 | Mueller et al. | 141/1 |
| 5,230,203 | 7/1993 | Wu et al. | 53/471 |
| 5,265,763 | 11/1993 | Heinrici et al. | 222/77 |
| 5,313,990 | 5/1994 | Clusserath | 141/90 X |

OTHER PUBLICATIONS

GTSI, Jagenberg-Gruppe Contitherm brochure entitled "Cup Filling and Sealing Machine for Products of Today and Tomorrow", published prior to May 1994.

*Primary Examiner*—Henry J. Recla
*Assistant Examiner*—Steven O. Douglas
*Attorney, Agent, or Firm*—Pettis & McDonald

[57] ABSTRACT

An improved product filling machine adapted to dispense product into containers that are advanced by standard conveyor systems. The component parts of the product filling machine are modular, permitting rapid repair, cleaning and flexibility in adapting the machine to various product packaging apparatuses. The product filling machine has clean-in-place capability and structure for flushing the machine with sterile air after cleaning and maintaining pressurized sterile air within portions of the product filling machine during the filling operation.

7 Claims, 8 Drawing Sheets

APPARATUS AND METHOD OF OPERATION FOR A PRODUCT FILLER MACHINE

BACKGROUND OF THE INVENTION

1. Field of the Invention

The present invention relates to an improvement to product filling machines used in the packaging of food products within containers that are movable along a conveyor system. More particularly, the invention relates to a modular filling machine with clean-in-place apparatus and means for maintaining pressurized sterile air within portions of the filling machine during the operation of the machine.

2. Description of the Prior Art

One of the key design features considered during the development of filling machines, is the inclusion of methods for maintaining cleanliness during operation of the product line and methods to permit rapid cleaning of the machine in place after a product run. Many current designs include the dosing pump and frequently the product distribution valve within the product hopper as a means for isolating the dosing pump and its related apparatus from the ambient air to reduce the risk of contaminants entering the product filling machinery. However, by installing the dosing pumps and valve within the product hopper, cleaning of the individual dosing pumps and valves is much more difficult and time consuming. In addition, repairs to individual dosing pumps or valves may require disassembly of the hopper making repairs difficult and time consuming. What is needed then, is an apparatus that is comprised of easily accessible modular parts, for ease of replacement and cleaning, which still includes a means for preventing the entry of contaminated ambient air into the filling machine.

SUMMARY OF THE INVENTION

The present invention provides an improved product filling machine that is usually installed as a component of product packaging apparatus that utilize a conveyer system to transport containers between the individual component machines. The overall packaging apparatus may be mounted on a support frame, or each of the apparatus components may be stand-alone devices that are attached to the floor or fixed in place by some other well known means.

The product filling machine of this invention comprises a frame that may be joined to the frame of the packaging apparatus or may be fastened to the floor in its proper position. A product hopper is mounted to the frame and is connected to a product source for filling the hopper with product. A valve means is mounted to the frame adjacent to but external from the hopper. The valve means is connected in fluid flow relation to the hopper for selectively dispensing a predetermined amount of product to a container. A pump means is connected to the frame so that it is external the product hopper. The pump means delivers a predetermined amount of product to the valve means for delivery to the container. A means for providing a cleaning fluid is connected in fluid flow communication to the product hopper so that the filling machine may be flushed by the cleaning fluid. A means for providing a sterile gas at pressures above ambient pressure is connected in fluid flow communication to the hopper so that portions of the filling machine may be maintained at pressures above the ambient air pressure to preclude the entry of contaminants.

BRIEF DESCRIPTION OF THE DRAWINGS

For a full understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
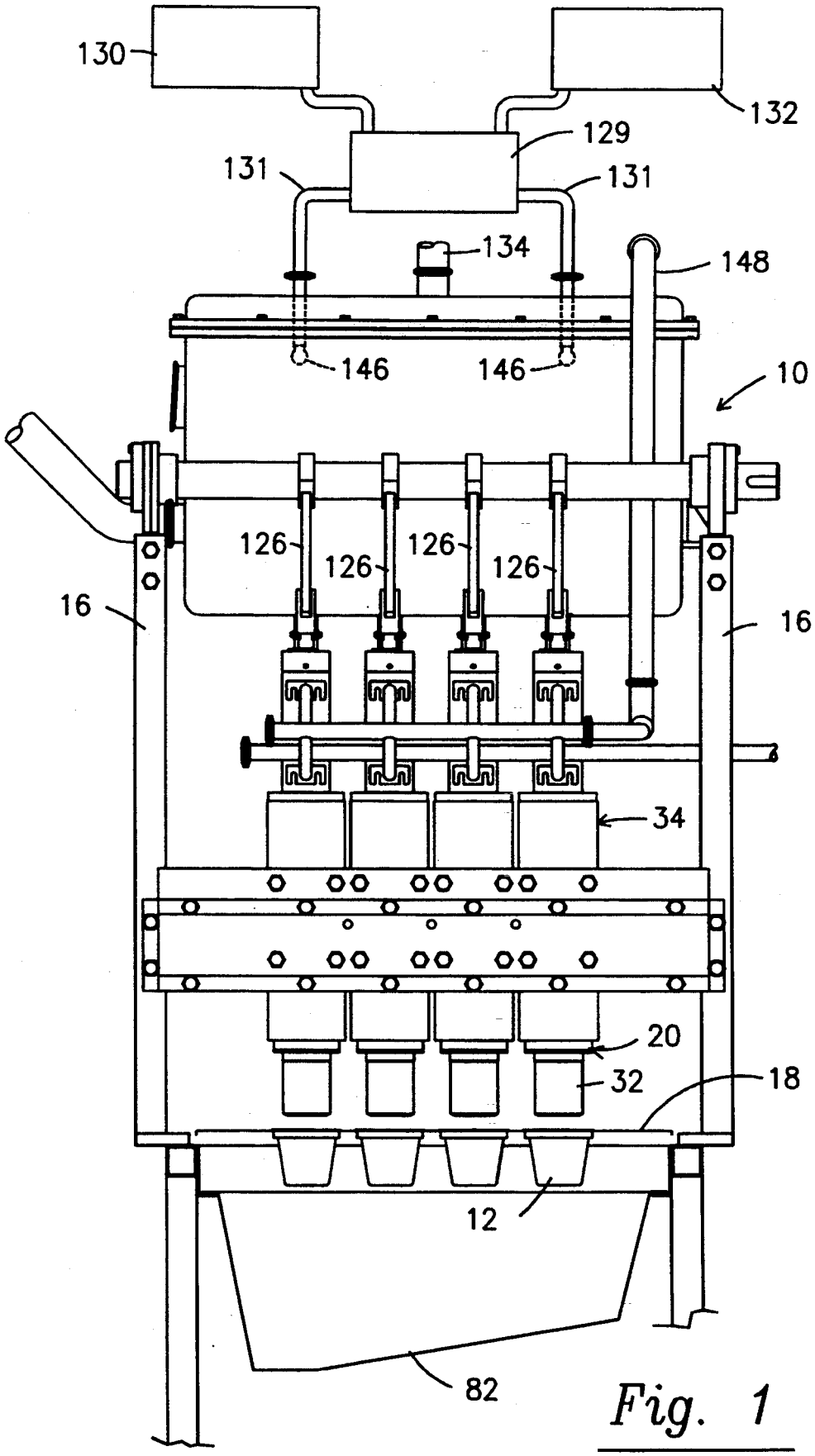
FIG. 1 is a front elevation view of a preferred embodiment of the invention.
Figure 2:
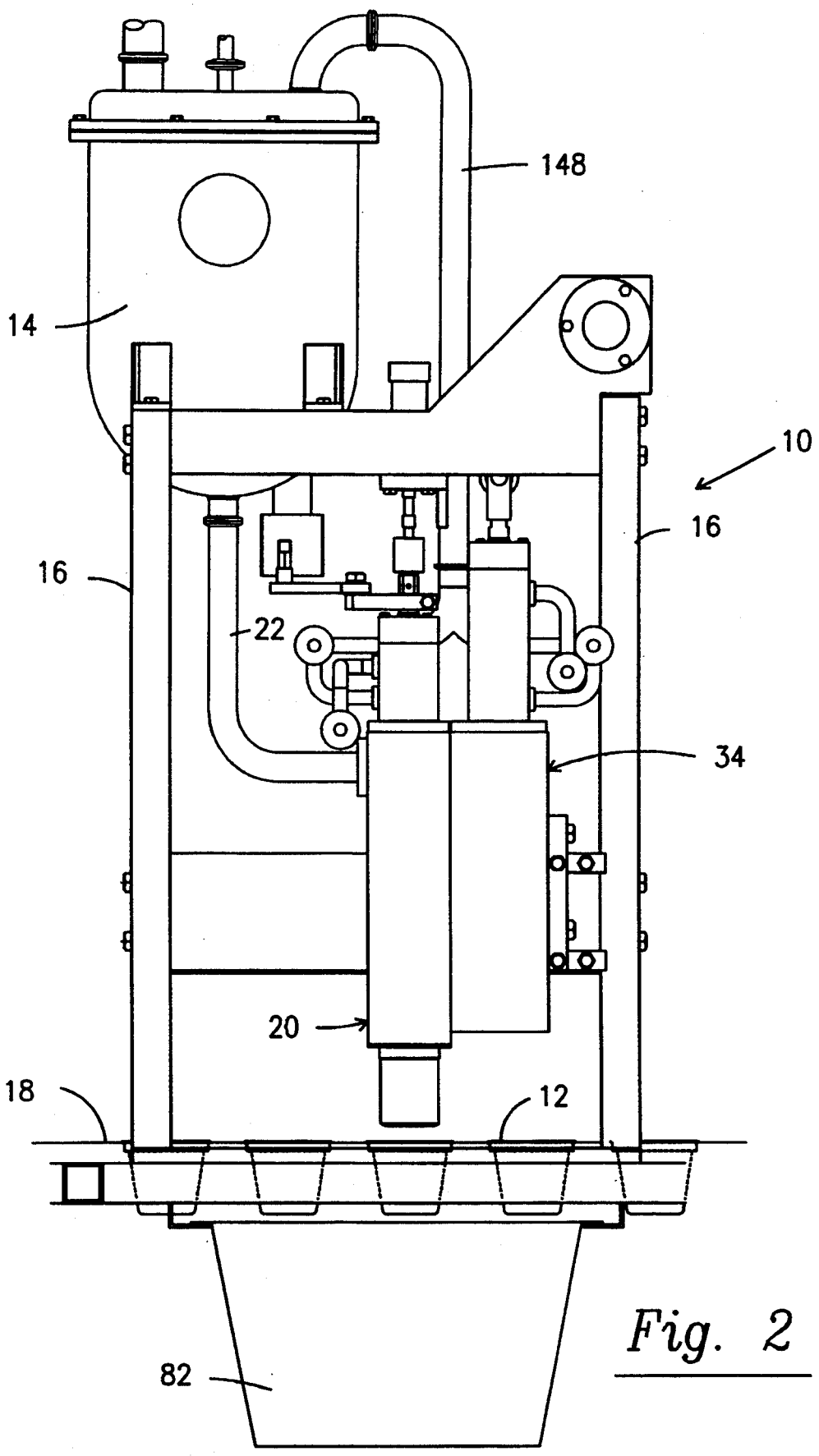
FIG. 2 is a left side elevation view of the invention of FIG. 1.

FIG. 1 illustrates a preferred embodiment of the product filling machine of this invention, generally indicated as 10. The filling machine 10 is capable of filling four containers, indicated as 12, at a time; however, other embodiments of filling machine 10 may be configured to simultaneously fill any number of containers 12 that the packaging apparatus is designed to process at a time. FIG. 2, illustrates the modular components necessary to fill a single container 12. Of course, the same modular components for dispensing product into each of the three other containers 12 of the four container system, as illustrated in FIG. 1, are hidden therebehind. For simplicity, we will describe a single set of components with the understanding that, with the exception of the product hopper 14, a generally similar set of components are required to fill each of the second, third and fourth containers 12. This modular design provides simplicity and flexibility during the design and construction of a product filling machine, as the same components are used but are attached together in different configurations, only requiring different piping and manifold designs as appropriate.

In this preferred embodiment, as seen in FIGS. 1 and 2, a frame 16 that supports the components of this invention also supports the conveyor system 18 of the packaging apparatus (not shown). In other embodiments, the conveyor system 18 may be free standing in relation to the filling machine 10.

Figure 3:
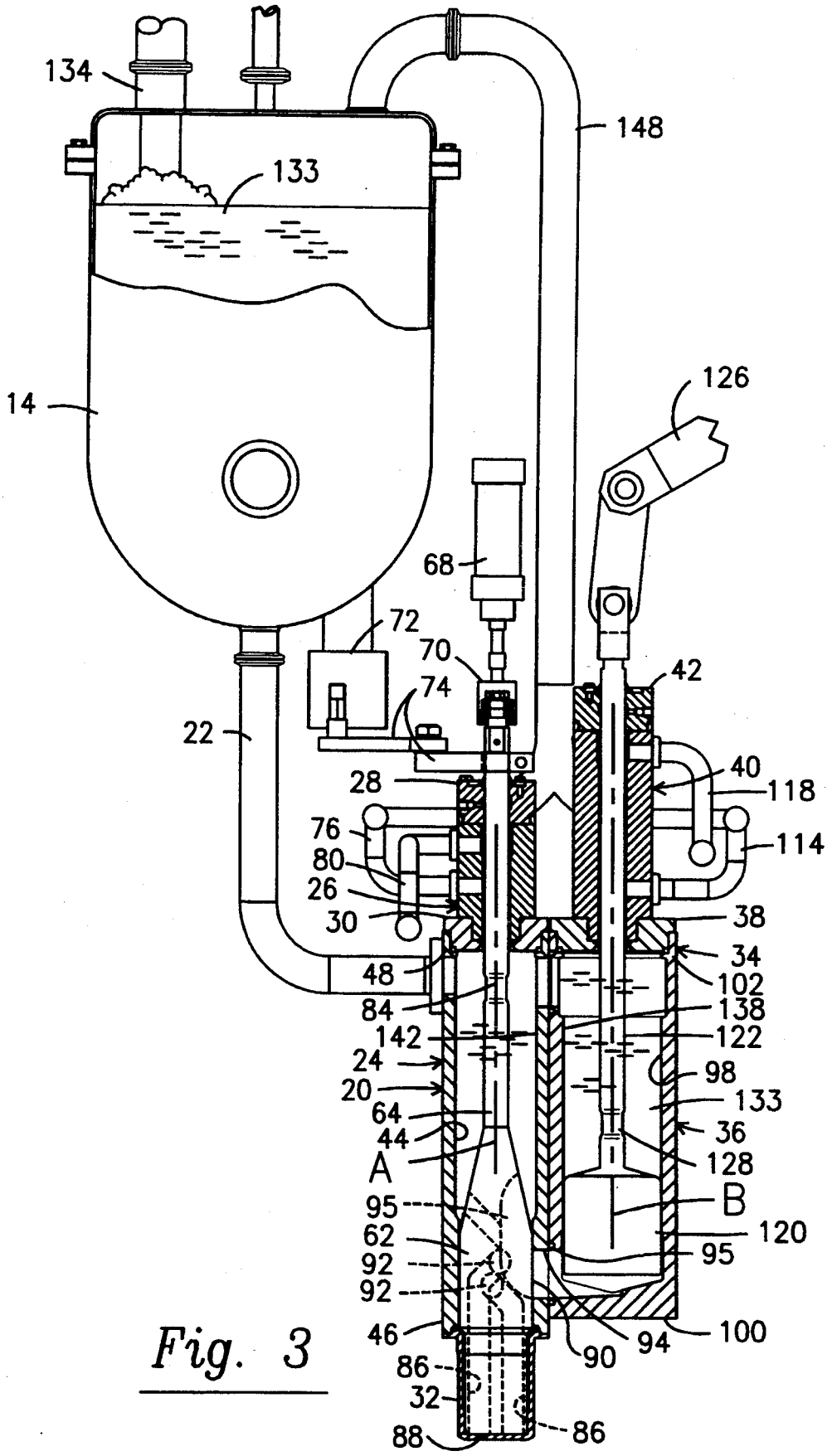
FIG. 3 is an enlarged partial cross-sectional view of the invention of FIG. 2, illustrating the position of the parts of the invention just prior to the beginning of the pump fill cycle.

As best shown in FIG. 3, the current invention comprises a product hopper 14 that is mounted on the frame 16, a valve means, shown generally as 20, that is also connected to the frame 16, and is connected in fluid flow relation to the hopper 14 by a pipe 22. The valve means 20 is comprised of a number of modular components including: a valve block 24, a valve seal block 26, a valve bearing block 28, a valve cap block 30, and a nozzle 32. A pump means, shown generally as 34, is connected in fluid flow relationship with the valve means 20 and is supported on the frame 16. The pump means 34 is external from the hopper 14 and is comprised of a number of modular components including: a pump block 36, a pump cap block 38, a pump seal block 40 and a pump bearing block 42.

The valve block 24 has a longitudinal bore 44 that extends from the first end 46 to the second end 48 of the valve block. The valve cap block 30 is attached to the second end 48 of the valve block and has a hole 50 therethrough whose center is generally aligned with the longitudinal axis A of the valve block bore 44, which is more clearly seen in FIG. 7.

Figure 7:
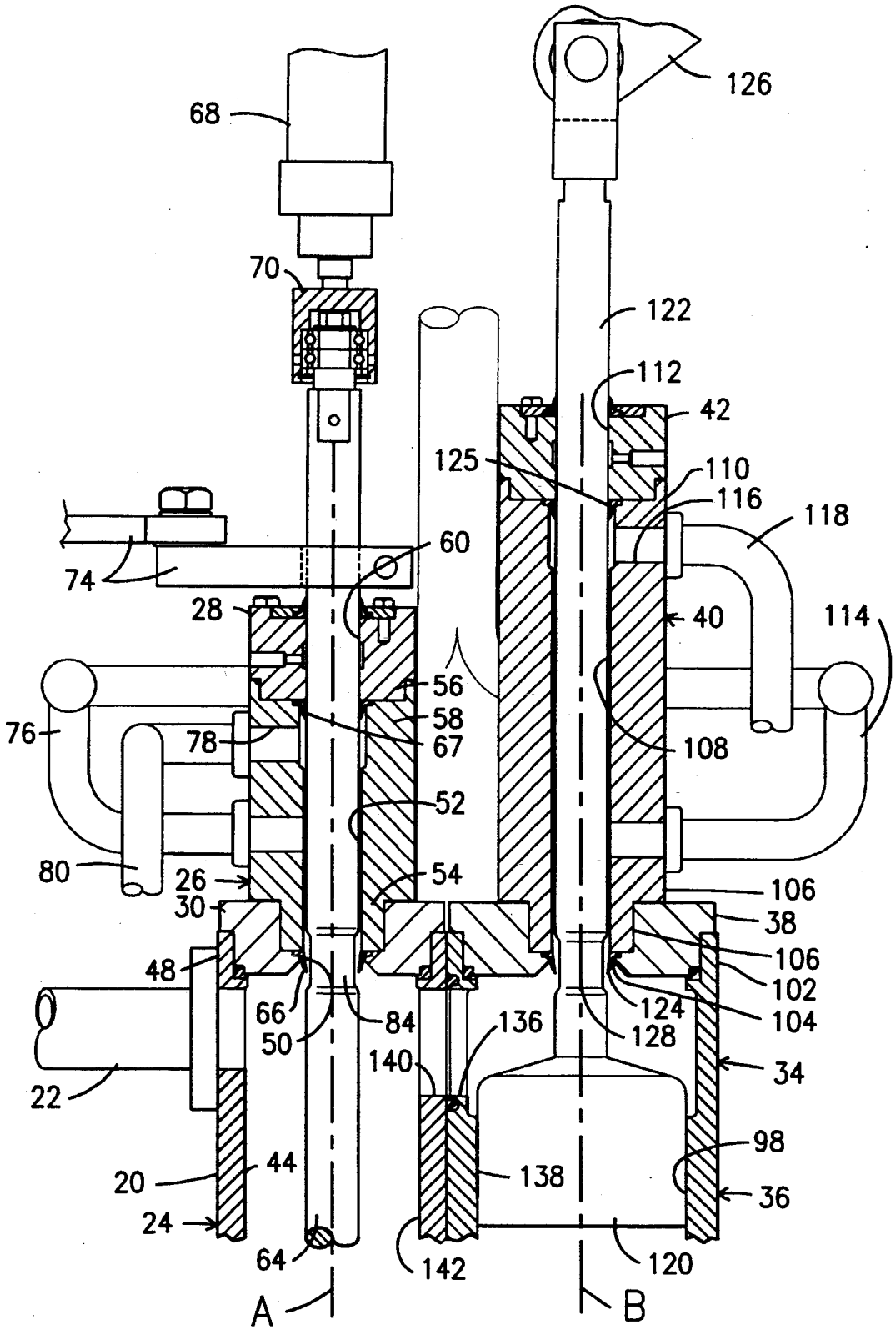
FIG. 7 is a detailed view of the invention of FIG. 6, illustrating the valve seal block and the pump seal block in greater detail.

As best seen in FIG. 7, the valve seal block 26 has a longitudinal bore 52 therethrough whose longitudinal axis is generally coincident with longitudinal axis A when the first end 54 of the valve seal block 26 is attached to the valve cap block 30. The first end 56 of the valve bearing block 28 is attached to the second end 58 of the valve seal block 26 so that the longitudinal axis of the bore 60 through the valve bearing block 28 is generally coincident with the longitudinal axis A.

As seen in FIG. 3, a valve body 62 with a valve shaft 64 attached thereto is disposed within the longitudinal bore 44 of the valve block 24 so that the valve body 62 is proximal the first end 46 of the valve block 24 and the valve shaft 64 extends upwardly with its axis generally coincident with the longitudinal axis A. The shaft 64 extends through the bore 44 of the valve seal block 24, through the hole 50 of the valve cap block 30, through the bore 52 of the valve seal block 26 through the bore 60 of the valve bearing block 28 and outwardly therefrom. The valve body 62 is sized to fit tightly within the valve block bore 44, but with sufficient tolerance to permit rotation and longitudinal movement therein. The valve shaft 64 has a much smaller diameter than the diameter of the bore 44 providing room for the flow of product therebetween. The shaft 64 passes through the hole 50 in the valve cap block 30 with sufficient clearance to permit the attachment of a valve seal 66 to the sides of the hole 50. The valve seal 66 prevents contaminants from entering the valve block 24 and prevents food product from entering the valve seal block 26. In the preferred embodiment, the valve seal 66 is comprised of neoprene rubber, but the seal may be comprised of any suitable material and be formed in any suitable design that is well known in the art and is suitable for use in the food industry. A valve seal block seal 67 is mounted within the second end 58 of the valve seal block 26 to prevent contaminants, including grease, from entering the valve seal block 26.

The valve shaft 64 is held in alignment by the valve bearing block 28, which also provides means for lubrication of the valve shaft 64 for longitudinal and rotational movement of the valve shaft 64. The end of the shaft 64, that is distal the valve body 62, is attached to a pneumatic cylinder 68 for longitudinal movement of the shaft 64. The valve body 62 is attached to the pneumatic cylinder 68 by a journal support 70 that permits rotational movement of the shaft 64 as well as longitudinal movement. Rotational movement of shaft 64, of approximately 90°, is created by a second pneumatic piston 72 that is attached to the shaft 64 by a pair of links 74. Both pneumatic cylinders 68 and 72 are connected to the frame 16 for support thereon. Mechanical means well known in the art may be substituted as desired for either or both of the pneumatic pistons 68 and 72.

As seen in FIG. 7, the bore 52 through the valve seal block 26 is connected in fluid flow communication with the hopper 14 by a pipe 76. The bore 52 of the valve seal block 26 has an output aperture 78 connecting the bore 52 by a pipe 80 to the waste collection bin 82.

The valve shaft 64 has a bypass means, conveniently groove 84 that extends circumferentially about the valve shaft 64. The groove 84, when horizontally aligned with the valve seal 66, permits fluids to bypass the valve seal 66 and pass between the valve bore 44 and the valve seal block bore 52.

As seen in FIG. 3, the valve body 62 has a pair of ports 86 therethrough that extend from the bottom surface 88 of the valve body 62 to and through the side wall 90 of the piston 62. When the first ends 92 of the ports 86 are aligned with the aperture 94 that extends through the valve block 24 and the aperture 95 that extends through the pump block 36, the pump block 36 is in fluid flow communication with the nozzle 32. When a recess 96 (see FIG. 4) formed in the side wall 90 of the piston 62 is rotated into alignment with apertures 94 and 95, the bore 98 of the pump block 36 is in fluid flow communication with the bore 44 of the valve block 24. The recess 96 and the ports 86 open through the side wall 90 at approximately a 90° angle from one another, so that a rotation of the valve body 62 through 90° either aligns recess 96 with the apertures 94 and 95 or aligns the ports 86 with the apertures 94 and 95.

The pump block 36 has a bore 98 therethrough extending from the closed end 100 of the pump block 36 to the open end 102 (FIG.7). As seen in FIG. 7, the pump cap block 38 has a hole 104 therethrough whose center axis is generally coincident with the longitudinal axis B. The pump cap block 38 is attached to the second end 102 of the pump block 36. The first end 106 of the pump seal block 40 is attached to the pump cap block 38 so that the longitudinal axis of a bore 108 that extends through the pump seal block 40 is generally coincident with longitudinal axis B. Bearing block 42 is attached to the second end 110 of the pump seal block 40 so that the longitudinal axis of a longitudinal bore 112 extending through the bearing block 42 is generally coincident with longitudinal axis B.

The pump seal block 40 is connected in fluid flow communication with the product hopper 14 by a pipe 114 and the pump seal block 40 further comprises a pump seal block output aperture 116 that is connected in fluid flow communication by pipe 118 to the collection bin 82.

A pump piston 120 having a pump shaft 122 extending upwardly therefrom is disposed in the bore 98 of the pump block 36 so that the axis of the pump shaft 122 is generally coincident with the longitudinal axis B. The pump shaft 122 is spaced apart from the bore 98 providing space within the pump block 36 for product both above and below the pump piston 120. The hole 104 through the pump cap block is sized and configured so that the pump cap block can receive a pump seal 124 within the hole 104. The pump seal 124 is sized and configured to fit snugly about the circumference of the pump shaft 122 so that product is prevented from leaving the pump block bore 98 through the hole 104 in the pump cap block 38. Contaminants from the pump seal block 40 are also prevented from entering the pump block bore 98 by the pump block seal 124. The bearing block 42 maintains the position of the axis of the pump shaft 122 along the longitudinal axis B. A pump seal block seal 125 is mounted within the second end 110 of the pump seal block 40 to prevent contaminants, including grease, from entering the pump seal block 40. A linkage 126 is connected to the end of the pump shaft 122 that is distal from the pump piston 120. The linkage 126 is attached to a mechanical operating mechanism (not shown) that operatively raises and lowers the pump shaft 122 and the pump piston 120 through a predetermined distance in a predetermined cycle. The operating mechanism may comprise any mechanism well known in the art that is suitable for the purpose of providing a reciprocating motion to the pump piston 120. A pump seal bypass means, conveniently groove 128, is formed in the pump shaft 122, so that when it is positioned horizontally adjacent to the pump block seal 124, the bypass groove 128 permits fluids to bypass the pump block seal 124. Bypassing pump block seal 124 provides fluid flow communication between the bore 98 of the pump block 36 and the bore 108 of the pump seal block 40. The operating mechanism (not shown) selectively moves the pump shaft 122 with the pump shaft bypass groove 128, thereon, between an open position, when the bypass groove 128 is adjacent the pump block seal 124 and a closed position which is spaced apart from the pump block seal 124.

FIG. 1 illustrates schematically a means for providing a cleaning fluid 130, that is connected in fluid flow communication with the product hopper 14 by a manifold 129 and pipes 131. This apparatus and the cleaning fluid provided may comprise a pump and a source of cleaning fluid or any other method well known in the art that is suitable for the purpose. The cleaning fluid may be provided as a part of an overall plant clean-in-place system. This art is well known by those skilled in the art and will not be described further. Also, in FIG. 1, a means for providing a sterile gas is schematically represented as 132. In this embodiment, the sterile gas is conducted to the product hopper 14 through the same piping 131 used to conduct the cleaning fluid to the product hopper 14.

In the preferred embodiment the majority of all the parts that come into contact with food products are manufactured from stainless steel for ease of cleaning and for sterilization purposes. In a preferred embodiment the seals are comprised of neoprene rubber and the bearing blocks may be made from bearing materials.

As previously mentioned, the filling machine illustrated in this preferred embodiment may be configured to support many different styles of packaging apparatus that utilize a filling machine of this type. In the embodiment illustrated in FIG. 1., there are 4 sets of modular components connected in fluid flow communication with a single hopper 14. A configuration of six sets of modular components may be used or two rows of four or many other suitable configurations can be made to fit the specific requirements of the packaging apparatus. Utilizing the modular components as disclosed by this invention, permits flexibility during construction, as the same components are used for each containers filling station but are attached together in different configurations, only requiring different frames, piping and manifold systems. In addition, these modular blocks are attached to one another and to the frame 16 for easy disassembly and cleaning or replacement of individual blocks, reducing down time. The interior portions of each of the blocks have sloping sides and are configured to allow maximum drainage of product and cleaning fluid so that after cleaning by the clean-in-place system any product residue remaining is minimal.

Figure 4:
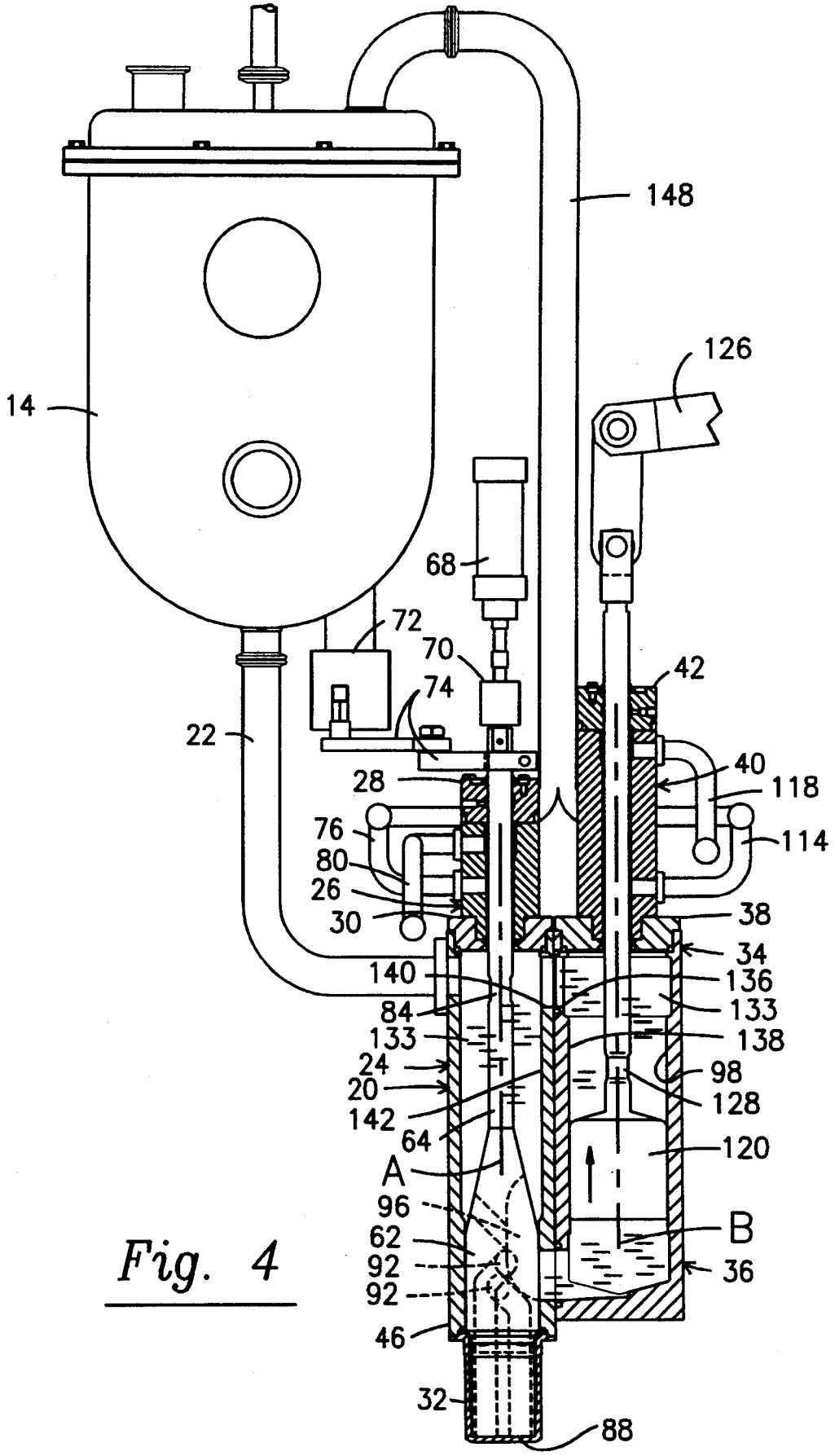
FIG. 4 is the invention of FIG. 3, illustrating the pump fill cycle.

With preferred embodiments of the apparatus of this invention having been described in detail above, the operation may now be described. The product 133 may be piped directly from a separate product manufacturing unit to the inlet 134 of the hopper 14, or the hopper may be filled by any other conventional means. An electronic probe and valve system (not shown) are utilized to maintain a predetermined product level within the hopper 14. FIG. 3 illustrates the position of the moving parts of the filling machine 10, when the filling machine 10 has product 135 loaded therein in preparation for commencing the fill cycle of the pump block 36. As seen in FIG. 3, the product 135 now fills both the bores 98 and 44 of the pump block 36 and the valve block 24 respectively. As seen in FIG. 4, the actuating mechanism (not shown) operates to lift the pump piston 120 in an upward direction forcing the product above the piston 120 to pass through the aperture 136 through the wall 138 of the pump block 36 and through the aperture 140 in the valve block wall 142. The apertures 136 and 140 are identically sized and configured so that when aligned with one another the bore 98 of the pump block 36 is in fluid flow communication with the bore 44 of the valve block 24. The wall 138 of the pump block and the adjacent wall 142 of the valve block are so configured that when attached to one another by bolts or any other well known means they are searingly attached to one another. As seen in FIG. 3, the aperture 95 through the pump block wall 138 and the aperture 94 through the valve block wall 142 are similarly configured so that they are searingly aligned with one another to provide a fluid flow communication between the pump block bore 98 and the valve block bore 44 proximal the first end 100 of the pump block 36.

As shown in FIG. 4, as the pump piston 120 moves upwardly, product is forced through 136 and 140 and downwardly through the valve body recess 96 and through the apertures 94 and 95, circulating the product within the bores 44 and 98. The pump piston 120 stops at a predetermined height within the pump block bore 98 based on the amount of product to be dispensed into a container 12.

Figure 5:
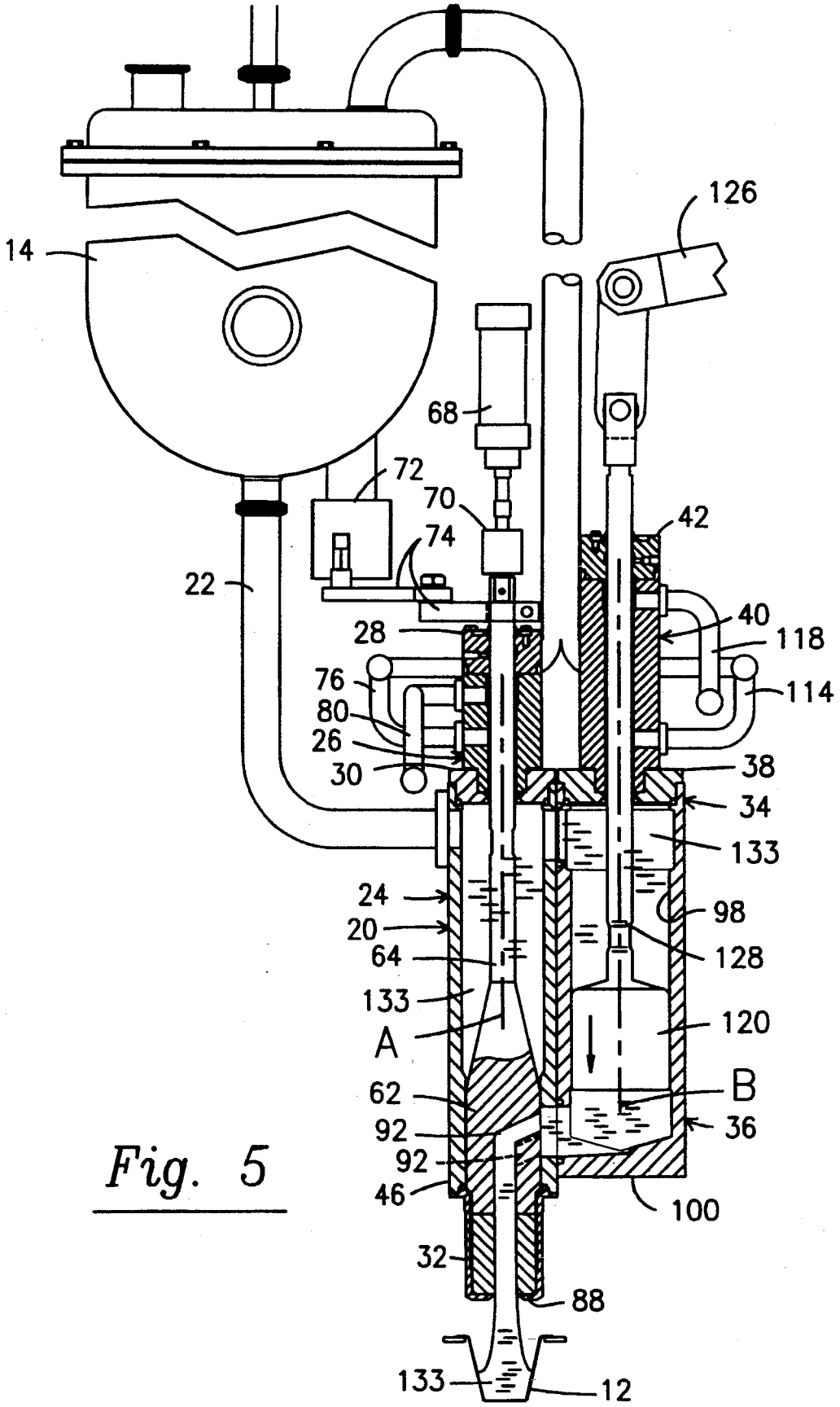
FIG. 5 is the invention of FIG. 3, illustrating the product dispensing cycle.

As shown in FIG. 5, after the pump piston 120 has reached its maximum the valve body 62 rotates so that the ports 86 are aligned with the apertures 94 and 95. As the pump piston 120 moves downwardly the product passes through the apertures 94 and 95 and through the ports 92 and out the nozzle 32 being dispensed into a container 12. The cycle illustrated by FIGS. 3, 4, and 5 are repeated until the particular product run is completed.

Figure 6:
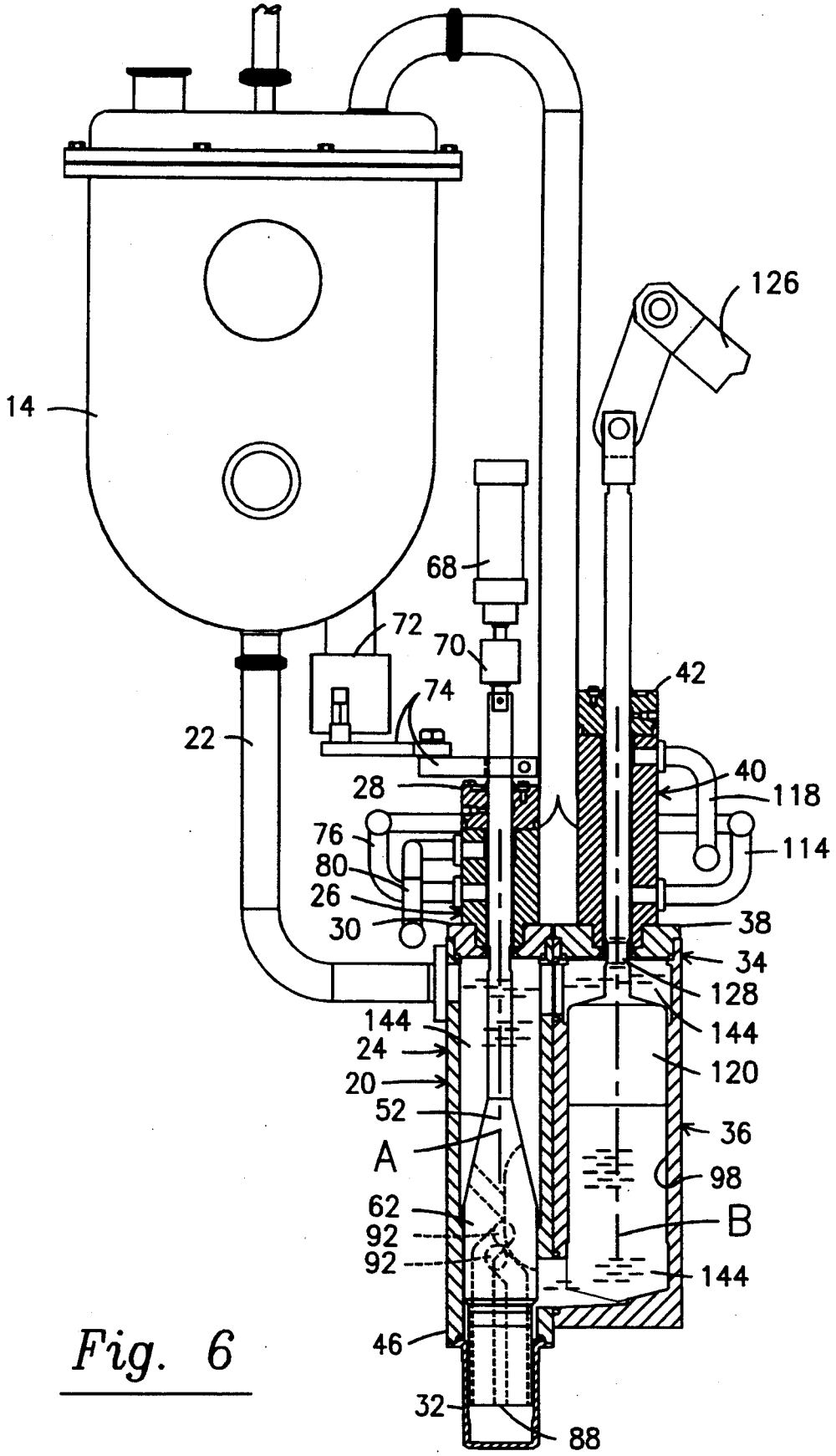
FIG. 6 is the invention of FIG. 3 illustrating the positioning of the valve body and the pump piston in the open bypass position for bypass of the respective valve block seal and pump block seal.
Figure 8:
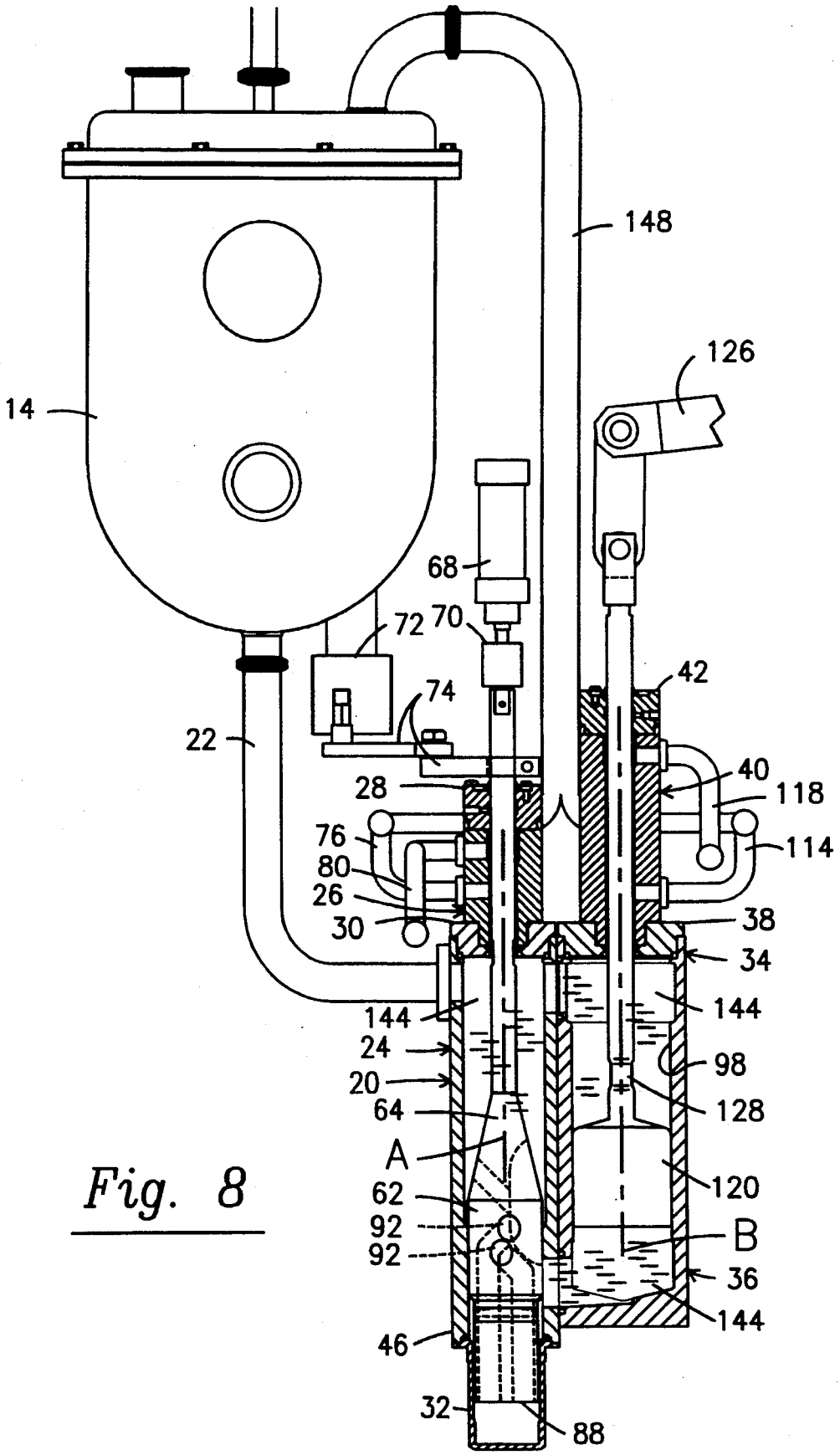
FIG. 8 is the invention of FIG. 3, illustrating the flow of the clean-in- place cleaning fluid.

Upon completion of a particular product run the filling machine 10 is switched into the clean-in-place mode to clean the modular parts prior to commencing a second product run. As shown in FIG. 6, in the clean-in-place mode the pump piston 120 is raised into the open bypass position in which the pump block seal bypass groove 128 is adjacent to the pump block seal 124 permitting the cleaning fluid 144 to pass between the pump seal block bore 108 and the pump block bore 98. During the clean-in-place operation, the pump block piston 120 operates between the open bypass position and the fully downward position so that the cleaning fluid 144 is flushed throughout the filling machine 10. The valve body 62 is raised by the pneumatic cylinder 68 to the open bypass position in which the valve bypass groove 84 is adjacent the valve block seal 66 permitting cleaning fluid to pass between the pump seal block bore 26 and the pump block bore 44 flushing these areas of the machine 10. The cleaning fluid 144 is pumped to the filling machine 10 by the means for providing the cleaning fluid, shown schematically on FIG. 1 as 130, so that the cleaning fluid enters the hopper 14 through the spray nozzle 146 as shown in FIG. 1. The volume of flow of the cleaning fluid 144 is greater than can be dispensed through the nozzle 32 into the collection bin 82, therefore the cleaning fluid 144 fills the hopper 14 and passes through pipe 148 which connects with pipes 114 and 76 to provide a flow of the cleaning fluid 144 into the pump seal block 40 and the valve seal block 26. The cleaning fluid 144 will then flow downwardly through the respective pump block seal bypass groove 128, when open, and the valve block seal bypass groove 84, flushing these areas. The overflow of the cleaning fluid in bore 52 of the valve seal block 26 and bore 108 of the pump seal block 40 will exit through output aperture 78 and output aperture 116 respectively. The cleaning fluid 144 carrying product residue flows to the collection bin 82 through pipe 80 and pipe 118 respectively. As shown in FIG. 8, the valve bypass remains in the open position and the pump piston 120 is permitted to reciprocatingly operate between the pump bypass means and the fully downward position providing a pumping and flushing action.

When the cleaning cycle is completed sterile air is provided to the hopper 14 by the means for providing sterile air 132, shown schematically in FIG. 1. The sterile air enters under pressure above the existing ambient pressure so that ambient air will not intrude into the filling machine 10 from the exterior. Air is processed through a sterile filter, such as those produced by Zanders. These filters are sized for a particular filling machine size. Sterile air systems are well known in the art and any system suitable for the purpose may be used in place of the Zanders filters. The sterile air 148 passes through the system in a similar fashion as the cleaning fluid 144.

To commence a new run of product, the pump piston 120 and the valve body 62 are removed from the open position so that the pump piston 120 cycles between a maximum predetermined upward position and the lower position proximal to the first end 100 of the pump block 36. The product is then pumped into the product hopper 14 for further processing as discussed previously. With the bypass means 128 and 84 in the closed position the sterile air will circulate only within the pump seal block 40 and the valve seal block 26. By pressurizing the pump seal block 40 and the valve seal block 26 contaminants will be prevented from entering the respective bores 108 and 52 and thus entering the areas in which food is being processed.

While the foregoing description is directed to a particularly preferred embodiment of the present invention, it is to be understood that these embodiments are representative of only of the principles of the invention and are not to be considered imitative thereof. Because numerous variations and modifications of both the apparatus and the method all within the scope of the present invention, will become apparent to those skilled in the art, the scope of the invention is to be limited solely by the claims appended hereto.

What is ciaimed is:

1. An improved product filling machine for dispensing product into a container, said filling machine comprising:

a frame;

a product hopper mounted to said frame;

valve means connected in fluid flow relation to said hopper, said valve means being external to said hopper and connected to said frame; said valve means comprising;

a valve block mounted to said frame, said valve block having a first end and a second end, said valve block having a longitudinal valve block bore therethrough, said valve block bore being connected in fluid flow relation to said hopper;

a valve body disposed in said valve block bore, a valve shaft attached to said valve body extending longitudinally within said valve block bore and extending outwardly from said second end of said valve block; and a valve seal block having a longitudinal bore therethrough, said valve seal block bore being connected in fluid flow communication with said hopper and said valve seal block bore having an output aperture, one end of said valve seal block connected to and aligned with said second end of said valve block such that said valve block bore is aligned with said valve seal block bore and said valve shaft extends through said valve seal bore;

pump means connected in fluid flow relation to said valve means, said pump means being external to said hopper and connected to said frame;

means for providing a cleaning fluid connected in fluid flow communication to said hopper; and means for providing a sterile gas at pressures above ambient pressure connected in fluid flow communication to said hopper.

2. An improved product filling machine as in claim 1 wherein said valve means further comprises a valve seal interposed between said valve seal block and said valve block, said valve seal searingly receiving said valve shaft therethrough, so that product is prevented from passing between said valve block and said valve seal block; valve bypass means formed in said valve body shaft; and means for raising said valve body being attached to said valve body shaft for selectively raising said valve bypass means such that said valve bypass means operatively engages said valve seal so that fluids bypass said valve seal.

3. An improved product filling machine for dispensing product into a container, said filling machine comprising:

a frame;

a product hopper mounted to said frame;

a valve means comprising a valve block mounted to said frame external to said hopper, said valve block having a first end and a second end, said valve block having a longitudinal valve block bore therethrough, said valve block bore being connected in fluid flow relation with said hopper;

pump means connected to said frame external to said hopper, said pump means comprising;

a pump block connected to said frame, said pump block having a longitudinal bore, said bore having a closed first end and an open second end, said pump block bore being connected in fluid flow relation with said valve block bore and being connected in fluid flow relation with said hopper; a pump piston slideably received in said pump block bore, and a pump piston shaft having a first end attached to said pump piston and a second end extending outwardly from said second end of said pump block bore; and a pump seal block having a longitudinal bore therethrough, one end of said pump seal block being connected to said second end of said pump block such that said pump seal block bore and said pump block bore are aligned and said pump shaft extends through said pump seal block bore, said pump seal block bore being connected in fluid flow communication with said hopper, and said pump seal block bore having an output aperture.

means for providing a cleaning fluid connected in fluid flow communication to said hopper; and means for providing a sterile gas at pressures above ambient pressure connected in fluid flow communication to said hopper.

4. A product filling machine as in claim 3 wherein said pump means further comprises a pump seal interposed between said pump seal block and said pump block, said pump seal searingly receiving said pump shaft therethrough, such that product is prevented from passing between said pump block and said pump seal block; pump bypass means formed in said pump shaft; and means for raising said pump piston being attached to said pump piston shaft for selectively raising said pump bypass means so that said bypass means operatively engages said pump seal such that fluids bypass said pump seal.

5. An improved product filling machine comprising:

a frame;

a product hopper mounted to said frame;

a valve block mounted to said frame external from said hopper, said valve block having a longitudinal bore therethrough, said valve block having a first end and a second end, said valve block bore being connected in fluid flow relation to said hopper, a valve block piston disposed in said valve block bore, said valve block piston having a valve body shaft attached thereto that extends longitudinally within said valve block bore and extends outwardly from said second end of said valve block;

a valve seal block having a longitudinal bore therethrough, said valve seal block bore connected in fluid flow communication with said hopper and said valve seal block bore having an output aperture, one end of said valve seal block being connected to said second end of said valve block such that said valve shaft extends through said valve seal block bore;

a valve seal interposed between said valve seal block and said valve block, said valve seal searingly receiving said valve shaft therethrough, whereby product is prevented from passing between said valve block and said valve seal block;

valve bypass means formed in said valve body shaft;

means for raising said valve body being attached to said piston shaft to selectively raise said bypass means such that said bypass means selectively operatively engages said valve seal, whereby fluids bypass said valve seal;

a pump block connected to said frame, said pump block being external to said hopper, said pump block having a longitudinal bore therethrough, said pump block bore being connected in fluid flow relation to said valve block bore and to said hopper; said bore having a closed first end, and an open second end, a pump piston slideably received by said pump block bore and a pump shaft having a first end attached to said pump piston and a second end extending outwardly from said second end of said pump block bore;

a pump seal block having a longitudinal bore therethrough, said pump seal block bore being connected in fluid flow communication with said hopper, and said pump seal block bore having an output aperture, one end of said pump seal block being connected to said second end of said pump block such that said pump seal block bore and said pump block bore are aligned and said pump shaft extends through said pump seal block bore;

a pump seal interposed between said pump seal block and said pump block, said pump seal searingly receiving said pump shaft therethrough, whereby product is prevented from passing between said pump block bore and said pump seal block bore;

pump bypass means formed in said pump shaft; and means for selectively raising and lowering said pump piston being attached to said pump piston shaft to selectively raise said pump bypass means such that said bypass means operatively engages said pump seal, whereby fluids bypass said pump seal means;

a nozzle attached in fluid flow communication to said first end of said valve block;

at least one port formed in said valve body selectively connecting, in fluid flow communication, said pump block with said nozzle and a recess in said valve body selectively connecting in fluid flow communication said valve block bore to said pump block bore;

means for providing a cleaning fluid connected in fluid flow communication with said hopper; and means for providing a sterile gas connected in fluid flow communication with said hopper.

6. A method for cleaning in place and maintaining a sterile interior of a product filler machine that comprises a frame upon which are mounted a product hopper, a pump block external to said product hopper, a pump seal block, a pump seal disposed between the pump block and the pump seal block, a bypass means for bypassing the pump seal, the pump seal bypass means being operable between an open and closed position, a valve block external to said product hopper, a valve seal block, a valve seal disposed between the valve block and the valve seal block, a valve seal bypass means for bypassing the valve seal, the valve seal bypass means being operable between an open and a closed position, the product hopper being connected in fluid flow communication with the valve block, the valve seal block and the pump seal block, and the valve seal block and the pump seal block each having an output aperture, the method comprising the steps of:

a. draining all food product from said product filler machine to a collection bin;

b. moving said pump seal bypass means and said valve seal bypass means from a closed position to an open position;

c. pumping a cleaning fluid into said hopper at a faster rate than said cleaning fluid can drain from said hopper through said valve block such that a portion of said cleaning fluid passes from said hopper, through said valve seal block, through said valve seal bypass means to said valve block and out said valve seal block output aperture, and a portion of said cleaning fluid passes from said hopper through said pump seal block and out said pump seal block output aperture, said cleaning fluid carrying residue of said food product therewith, thereby flushing said valve seal block and said pump seal block, said cleaning fluid passing through and flushing said pump means and said valve means, said fluid, carrying residue of said food product therewith, exiting said machine from said valve means;

d. stopping said pumping of cleaning fluid into said hopper;

e. pumping a sterile gas into said hopper at a pressure greater than ambient, a portion of said gas passing through said machine and out said pump block, a portion of said gas passing out said valve seal block output aperture and a portion of said gas passing out said pump seal block output aperture;

f. stopping said pumping of said sterile gas;

g. moving said valve block bypass means and said pump block bypass means to respective said closed positions;

h. pumping product into said hopper; and i. operating said machine whereby said product is dispensed therefrom into a container.

7. A method for cleaning in place and maintaining a sterile interior of a product filler machine wherein said pump block, said pump seal block, said valve block, said valve seal block, a valve bearing block, and a pump bearing block comprise a group of blocks, and wherein the steps of claim 6 further comprise, after step d the steps of:

d-1) selecting at least one block from said group of blocks;

d-2) remove only said selected block and disassemble for cleaning and repair; and d-3) reassemble said selected block and reattach to said product filler machine.

* * * * *

UNITED STATES PATENT AND TRADEMARK OFFICE

CERTIFICATE OF CORRECTION

PATENT NO. : 5,431,198

DATED : July 11, 1995

INVENTOR(S) : Alfons Turtchan, et. al.

It is certified that error appears in the above-indentified patent and that said Letters Patent is hereby corrected as shown below:

Column 8, line 40, delete "searingly" and insert therefor --sealingly--.

Column 9, line 22, delete "searingly" and insert therefor --sealingly--.

Column 9, line 53, delete "searingly" and insert therefor --sealingly--.

Column 10, line 16, delete "searingly" and insert therefor --sealingly--.

Signed and Sealed this

Twenty-fourth Day of October, 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. :5,431,198

DATED :July 11, 1995

INVENTOR(S) :Alfons Turtschan, *et al.*

It is certified that error appears in the above-indentified patent and that said Letters Patent is hereby corrected as shown below:

On the title page, under item [19] and item [75], delete "Turtchan" and insert therefor --Turtschan--.

Signed and Sealed this

Twenty-first Day of May, 1996

*Attest:*

Bruce Lehman

BRUCE LEHMAN

*Attesting Officer*

*Commissioner of Patents and Trademarks*